United States Patent [19]

Harner et al.

[11] Patent Number: 5,049,184

[45] Date of Patent: Sep. 17, 1991

[54] METHOD OF MAKING A LOW THERMAL EXPANSION, HIGH THERMAL CONDUCTIVITY, COMPOSITE POWDER METALLURGY MEMBER AND A MEMBER MADE THEREBY

[75] Inventors: Leslie L. Harner, Ruscombmanor Township, Berks County; Gregory J. Del Corso, Brecknock Township, Berks County, Pa.

[73] Assignee: Carpenter Technology Corporation, Reading, Pa.

[21] Appl. No.: 628,200

[22] Filed: Dec. 17, 1990

[51] Int. Cl.[5] ..... B22F 9/00

[52] U.S. Cl. ..... 75/246; 75/228; 75/248; 419/23; 419/38

[58] Field of Search ..... 75/228, 246, 248; 419/23, 38

[56] References Cited

U.S. PATENT DOCUMENTS

| | | | |
|---|---|---|---|
| 4,158,719 | 6/1979 | Frantz | 428/567 |
| 4,569,692 | 2/1986 | Butt | 75/235 |
| 4,822,693 | 4/1989 | Ashok et al. | 428/614 |
| 4,836,979 | 6/1989 | Bell et al. | 419/23 |

OTHER PUBLICATIONS

Hensel, F. R., Larsen, E. I., and Swazy, E. F., Physical Properties of Metal Compositions with a Refractory Metal Base, *Powder Metallurgy*, American Society for Metals, 1942, pp. 483–492.

ASM Metals Handbook, Powder Metallurgy, Ninth Edition, vol. 7, Jun., 1984, pp. 560, 561.

*Tungsten: Sources, Metallurgy, Properties, and Applications*, Yih and Wang (1979).

*Primary Examiner*—Stephen J. Lechert, Jr.

*Attorney, Agent, or Firm*—Dann, Dorfman, Herrell and Skillman

[57] ABSTRACT

In a process for making a low thermal expansion, high thermal conductivity member or article suitable for bonding to a support member at a predetermined bonding temperature and for facilitating heat transfer therefrom, and in the member made thereby, first and second metal powders are combined in volumetric proportions to provide an approximation to desired thermal expansion and thermal conductivity characteristics. The powder mixture is then consolidated in a controlled manner to provide a shaped member having a thermal expansion characteristic curve that essentially matches that of the support member from about 30° C. up to the bonding temperature. Consolidation of the metal powder mixture is controlled by selecting a density for the consolidated powder that results in the close expansion match over the temperature range and then consolidating the metal powder mixture to that density.

17 Claims, 2 Drawing Sheets

METHOD OF MAKING A LOW THERMAL EXPANSION, HIGH THERMAL CONDUCTIVITY, COMPOSITE POWDER METALLURGY MEMBER AND A MEMBER MADE THEREBY

BACKGROUND OF THE INVENTION

This invention relates to a powder metallurgy method for making a low thermal expansion, thermally conductive member and to an article or member made by the method, and in particular to such a process and article wherein the thermal expansion characteristic of a composite metal powder is closely matched to that of a low expansion material such as a ceramic or other low-electrical-conductivity material over a broad temperature range including the metal-to-ceramic bonding temperature.

Electronic packages such as microelectronic circuits and power semiconductor devices are sensitive to elevated temperatures during operation. The failure rate of such devices increases dramatically with increasing operating temperature. Accordingly, such devices are usually equipped with a member used to conduct heat away from the device, i.e., a heat sink. The heat sink is usually bonded to a support member of the device. Here and throughout this application the term "support member" is defined to mean any type of substrate or mounting base for an electronic package or device, including but not limited to ceramic substrates and printed circuit boards. The support member is often made of a ceramic material, such as alumina ($Al_2O_3$) or beryllia (BeO). The bonding techniques used include soldering or brazing. When a heat sink is bonded to a ceramic substrate by soldering or brazing, the temperature of the assembly may reach 800° C. or higher.

Among the performance characteristics desired in a heat sink are (a) good thermal conductivity to provide efficient heat transfer and (b) a thermal expansion characteristic that matches the thermal expansion characteristic of the ceramic support closely enough to minimize stresses caused by any expansion mismatch during the bonding process and during operation of the electronic package. Materials such as copper, silver, or aluminum, which have good thermal and electrical conductivity also have relatively high thermal expansion characteristics that result in undesirable expansion mismatch with the known ceramic support materials. Conversely, controlled thermal expansion materials such as "Kovar" ® or Invar provide a good thermal expansion match with a ceramic substrate, but do not provide the high thermal conductivity of copper, silver, or aluminum.

In response to the need for a good combination of thermal conductivity and thermal expansion matching, composite materials containing both a high thermal conductivity component and a low thermal expansion component have been developed hitherto. Such composite materials include metal laminates, metal powder composites, and metal infiltrated composite materials. Each type of known composite material has some drawback which limits its desirability.

For example, metal laminates which consist of a layer of low thermal expansion material sandwiched between two layers of a high thermal conductivity material provide a good thermal expansion match with a ceramic substrate and good thermal conductivity parallel to the plane of the layers. However, such laminates have less than desirable heat transfer capability in the direction perpendicular to the plane of the layers because of the low thermal conductivity of the center layer.

Metal-infiltrated components are prepared by compacting tungsten or molybdenum powder, sintering the compact to a predetermined porosity, and then infiltrating the porous, sintered compact with molten copper or silver. While such composites provide a good combination of thermal conductivity and thermal expansion matching with ceramic substrates, the manufacturing technique is difficult to control and leaves much to be desired.

U.S. Pat. No. 4,158,719, owned by Carpenter Technology Corporation, assignee of the present application, relates to a composite metal powder article that provides low thermal expansion and good thermal conductivity. The composite article is formed of a first metal powder having an average thermal expansion coefficient over the range 25° C. to 400° C. of less than about $12\times10^{-6}/°$ C., intermixed with a second metal powder having a thermal conductivity greater than that of the first metal powder. A shaped article is formed by compacting and sintering the metal powder mixture.

SUMMARY OF THE INVENTION

The present invention is an improvement over said U.S. Pat. No. 4,158,719. In accordance with one aspect of the present invention there is provided a novel process for making a low thermal expansion, high thermal conductivity member or article suitable for bonding to a support member at a predetermined bonding temperature and for facilitating heat transfer therefrom. Broadly stated, the process includes the step of combining a first metal powder, characterized by a low, average thermal expansion coefficient over the range from about 30° C. up to the bonding temperature and a second metal powder characterized by having a thermal conductivity higher than that of the first metal powder, and the step of controlling the consolidation of the metal powder mixture to a shaped member having a thermal expansion characteristic curve that essentially matches the thermal expansion characteristic curve of the support member over the range from about 30° C. up to The consolidation of the metal powder mixture is controlled by selecting a density for the metal powder mixture that results in a close match of the thermal expansion curves over the temperature range.

In a preferred embodiment of the process according to the present invention, the the first and second metal powders are combined by apportioning their respective volume fractions to provide a composite having a thermal expansion characteristic curve that approximates the thermal expansion characteristic curve of the ceramic material over the relevant temperature range.

In accordance with another aspect of the present invention there is provided a shaped, heat conducting member, such as a heat sink that is formed of a heterogeneous composite material containing the first and second metal powders, that is suitable for bonding to the support member at the predetermined bonding temperature, and which has been consolidated in a controlled manner to provide a thermal expansion characteristic curve that essentially matches that of the support member of the temperature range from about 30° C. up to the bonding temperature.

BRIEF DESCRIPTION OF THE DRAWINGS

Advantages of the present invention will be apparent from the following detailed description of the invention and the accompanying drawings, wherein.

DETAILED DESCRIPTION

Figure 1:
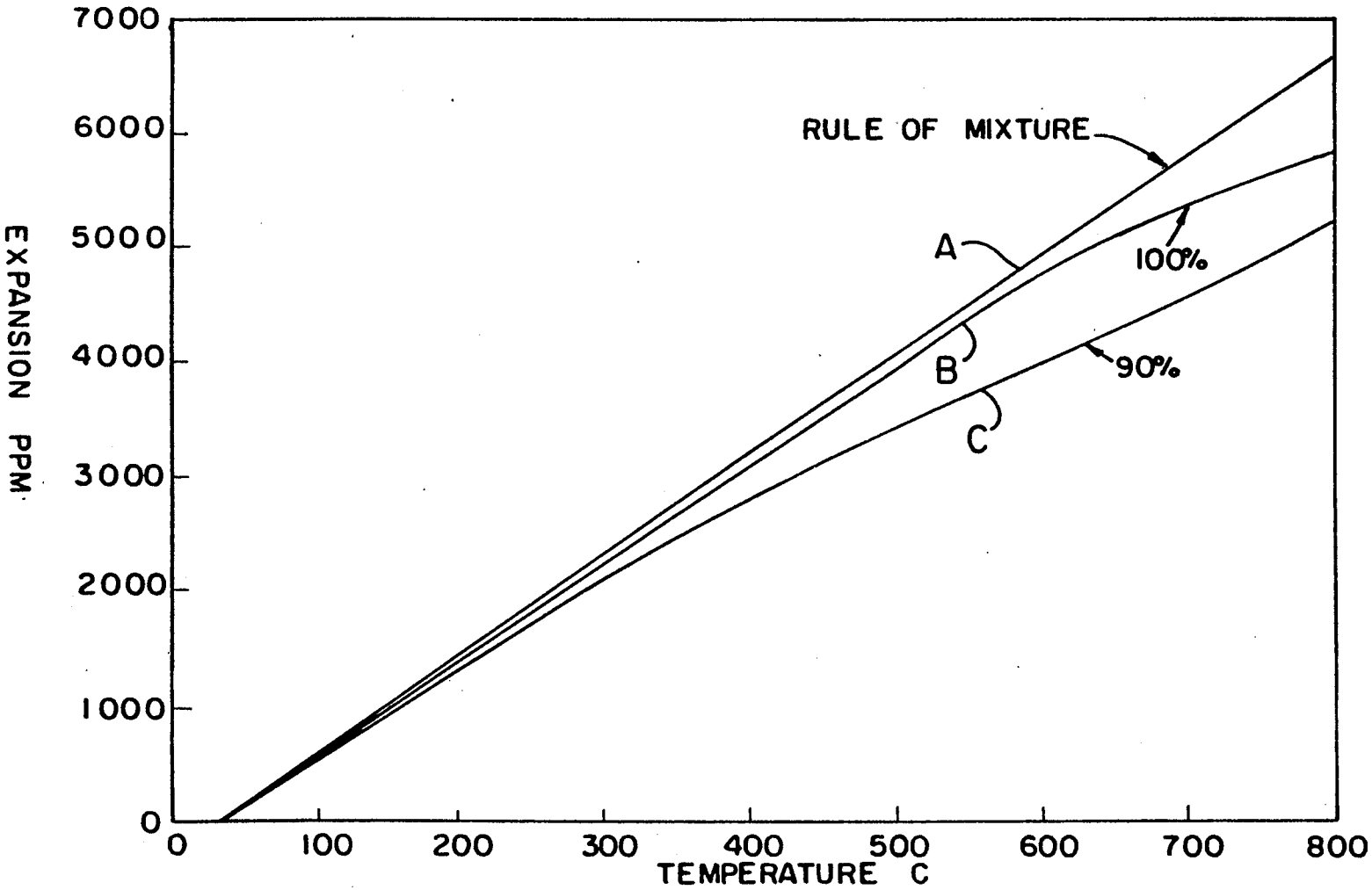
FIG. 1 is a graph of the theoretical thermal expansion curve for an 85 wt. % W, 15 wt. % Cu composite material together with graphs of the actual thermal expansion curves for the same composite material at 90% and 100% densities.

The process according to the present invention produces a heat conducting, composite powder metallurgy member having good thermal conductivity and a thermal expansion characteristic curve that closely matches that of a ceramic substrate material over the range from about 30° C. up to the metal-to-ceramic bonding temperature, typically about 800° C. Good thermal conductivity is necessary to provide effective heat transfer, whereas the close matching of thermal expansion characteristic curves is necessary to minimize stresses induced by thermal expansion mismatch between the composite member and the ceramic substrate.

Preferred metal powders that provide the desired low thermal expansion characteristic curve over the temperature range of interest include elemental tungsten and molybdenum. Pre-alloyed iron-nickel or iron-nickel-cobalt powders are also suitable as a low thermal expansion components. The compositions of such alloys are described in U.S. Pat. No. 4,158,719 which is incorporated herein by reference.

Metal powders that provide the desired high thermal conductivity include elemental iron, copper, nickel, aluminum, silver, gold, and platinum, copper being preferred. The high thermal conductivity powder and the low thermal expansion powder are preferably insoluble in each other so as to avoid any alloying between the component metal powders.

Each of the metal components is melted and formed into powder using well-known techniques. The preferred methods for making elemental powders are chemical (oxide reduction) or electrolytic techniques followed by mechanical comminution. The preferred method for producing pre-alloyed powder is by gas atomization; however, water atomization may be suitable where better compressibility and chemical homogeneity are desired and high purity is not essential.

Powder particle sizes not larger than about 40 microns are preferred because they facilitate blending the metal powders to a substantially uniform distribution of constituents throughout. Particle sizes up to about 420 microns can be used; however, they may cause a reduction in surface smoothness in a finished article and they are less suitable for making complex shapes. Accordingly, the particle size of the metal powders is selected based on the amount of segregation, the amount of intermetallic diffusion, and the part shape variation that can be tolerated for a particular article.

Any particle geometry can be used that has good compressibility and produces a compact of sufficient green strength to be handled and processed successfully to final shape and density. Irregularly shaped powder particles are preferred, but regular particles, such as spherically shaped particles can also be used, as well as mixtures thereof, provided the mixture has sufficient compressibility to produce a compact of acceptable green strength and density. Preferably, when irregular and spherical particles are used together, the quantity of irregular shaped particles is selected to ensure acceptable green strength.

When the as-consolidated product is to be less than 100% dense the metal powder mixture preferably contains at least about 5 weight percent (wt. %), better yet at least about 10 wt. %, of the high thermal conductivity component. Where a fully densified product is desired or required, however, the metal powder mixture preferably contains more than about 11 wt. %, and for best results at least about 15 wt. % of the high conductivity component.

The balance of the composite is the low thermal expansion component. However, up to 1 wt. % of a suitable wetting agent can be included to facilitate bonding between the high conductivity component and the low thermal expansion component when the composition is hot consolidated as by sintering. Suitable wetting agents include nickel, iron, chromium, and combinations thereof.

In making heat sink material in accordance with this invention the low thermal expansivity component and the high thermal conductivity component are preferably combined and blended in volumetric proportions to provide a composite material having the desired thermal expansivity as well as other properties desired for the final product. The material is characterized as being a composite because the constituent powder particles, which are thoroughly intermixed throughout, remain substantially distinct, with a minimum of alloying between constituents as will be discussed further hereinbelow. The desired proportions of the component metal powders can be first approximated by using the mathematical model known as the Rule-of-Mixtures. Examples of such mathematical models are described in "Mathematical models predict composite properties", *Advanced Materials & Processes,* p. 25, July 1989.

After the composite material based on the Rule-of-Mixtures has been consolidated to a first, preselected density, a better approximation to the desired thermal expansion characteristic curve is obtained. Any difference in magnitude between the thermal expansion characteristic curves of the ceramic substrate and the Rule-of-Mixtures composite material is then determined over the temperature range of interest, e.g., from about 30° C. up to the metal-to-ceramic bonding temperature. The volumetric proportions of the respective components are then adjusted to better approximate the thermal expansion characteristic curve of the ceramic substrate material. The step of apportioning the components in the metal powder composite will be more easily understood by referring to FIGS. 1 and 2 in connection with the following.

Shown in FIG. 1 are graphs of the thermal expansivity curves for a consolidated composite metal powder material containing 85 wt. % tungsten and 15 wt. % copper (72 vol. % W, 28 vol. % Cu). Curve A represents the theoretical expansivity of the material based on the Rule-of-Mixtures. Curve B represents the measured thermal expansivity of the composite material after consolidation to 100% of its theoretical density. Curve C represents the measured thermal expansivity of the composite material after consolidation to 90% of its theoretical density.

Figure 2:
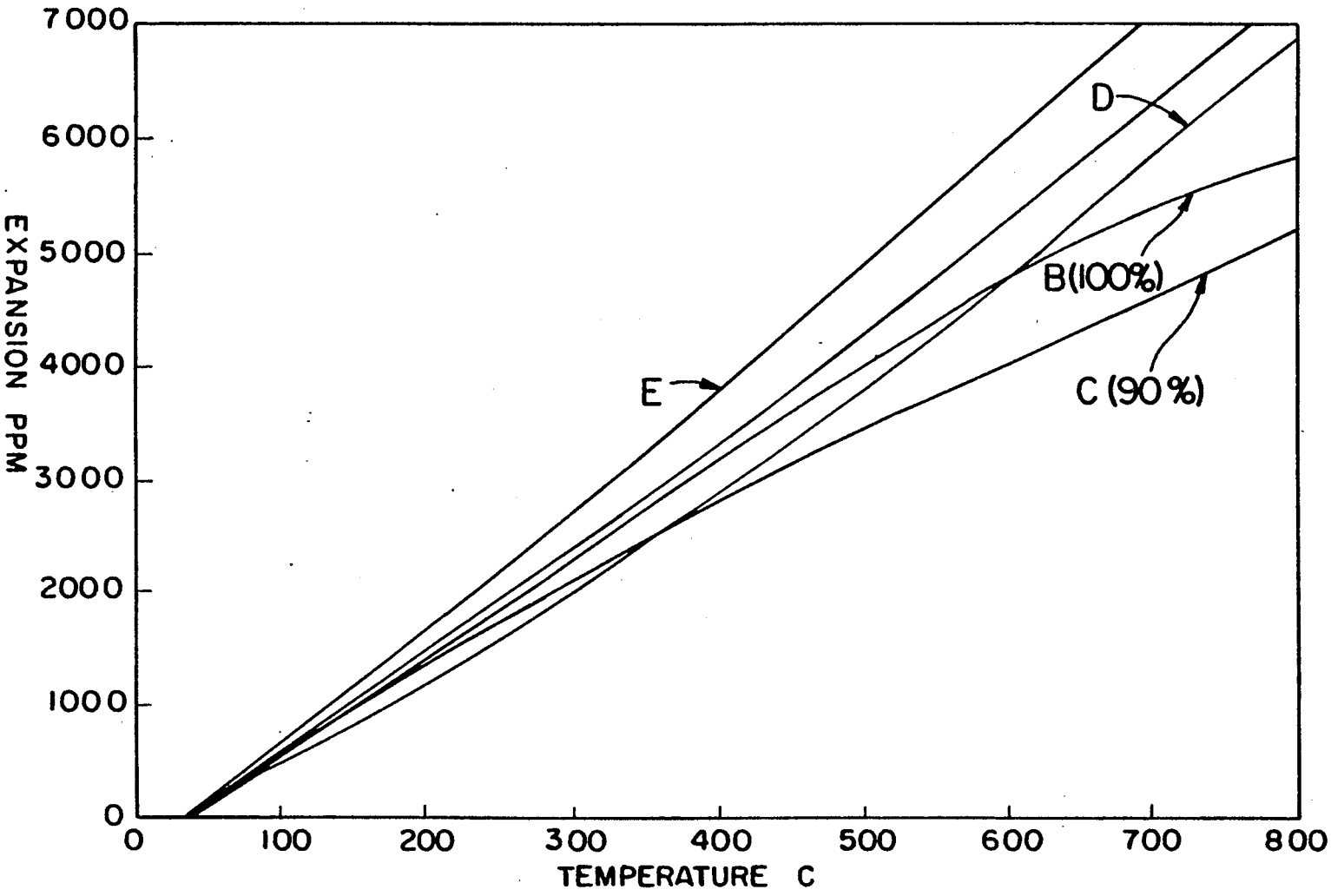
FIG. 2 shows graphs of the thermal expansion curves for beryllia, for the 85 wt. % W, 15 wt. % Cu composite material of FIG. 1, and for a 75 wt. % W, 25 wt. % Cu composite material.

FIG. 2 shows a graph of the thermal expansivity curve for beryllia (Curve D), a known ceramic substrate material, and graphs of curves B and C for the composite W-Cu material of FIG. 1. When necessary, as a further approximation, a closer expansion match between the ceramic material and the composite material at each density level is provided by increasing the volumetric proportion of copper in the composite material. Curve E represents the measured thermal expansivity of a composite metal powder material containing 75 wt. % tungsten and 25 wt. % copper (58 vol. % W, 42 vol. % Cu) and consolidated to 100% of theoretical density.

The specific volumetric proportion necessary in either case is readily determined by known methods For example, a calibration curve is generated from empirical test data to show the incremental change in thermal expansivity for varying powder component volume ratios at a constant level of porosity, that is, at a constant density. The increase in the volumetric proportion of the copper powder in the composite has the additional benefit of providing higher thermal conductivity in the final product, thereby enhancing its heat transfer capability.

The blended mixture of metal powders is consolidated by any suitable method. Selection of the specific consolidation method is dependent upon the shape of the part being made, the desired density of the part, and the quantity of the parts being made. For example, a hot consolidation technique such as the simultaneous consolidation and reduction of metal powder (SCR) disclosed in U.S. Pat. No. 4,693,863 or hot isostatic pressing (HIP'ng) are used alone or in combination to produce round or rectangular bar or block forms. An intermediate form made by such process is used to provide stock for machining of smaller parts. For example, such an intermediate form is sliced to produce small discs or rectangular plates from which one or more smaller parts are then machined. The SCR, HIP'ng, or SCR+HIP'ng processes are also used to produce shaped parts that are larger than those which can be made economically by pressing and sintering the blended powders. The SCR+HIP'ng process is preferred for making parts or compacts having a density of at least about 95% of the theoretical density.

Roll compaction of the blended component powders is the preferred consolidation technique for producing flat forms such as sheet, strip, or plate from which a part or parts can be readily machined, for example by stamping Roll compacting of flat forms provides a product density in the range of 80–95% of theoretical density. When additional strength or density is desired, the roll compacted composite material is sintered.

The press and sinter method is preferred for making small parts having complex shapes. A pressed and sintered part has a density in the range of 80–95% of theoretical density. The press and sinter process is desirable for the large scale manufacture of small parts, the machining of which would be prohibitive.

Curves B and C of FIGS. 1 and 2 show that the thermal expansivity of the composite material varies as the density of the material changes. The process of the present invention makes use of that anomaly in order to adjust the expansivity to a desired level. An important feature of the process according to the present invention is that the thermal expansion characteristic of the composite material is adjusted by controlling the amount of densification during consolidation of the metal powder mixture. For example, when the thermal expansion characteristic of a particular composition is too high at 100% of theoretical density, the material is consolidated to a lesser density in order to provide a lower thermal expansion characteristic. Curve F of FIG. 2 is illustrative of this aspect of the process according to the present invention because it represents the thermal expansivity of the 75 wt. % W, 25 wt. % Cu composite material of Curve E consolidated to about 90% of theoretical density and matches Curve D more closely than curve E. Conversely, the composition is consolidated to a greater density if the thermal expansion characteristic would otherwise be too low.

The blended mixture of metal powders is consolidated in a controlled manner to provide a shaped article, member, or product having a thermal expansion characteristic curve that essentially matches the thermal expansion characteristic curve of a support member, such as a ceramic substrate of an electronic package, over the temperature range from 30° C. up to the temperature for bonding the article to the support member. The consolidation of the metal powder mixture is controlled by selecting a density for the metal powder mixture that results in a close match of the thermal expansion characteristic curves of the shaped article and the support member. The density is selected by determining the thermal expansion characteristic curve of the metal powder mixture over the temperature range of interest, typically from about 30° C. up to the bonding temperature. The thermal expansion characteristic curve is determined for the mixture as-consolidated to a preselected density. The thermal expansion characteristic curve for the support member is known or readily determinable. Once both curves have been determined, any difference in the magnitude of the curves at the bonding temperature is then determined. The density for providing the desired best match is readily determined by known methods. For example, a calibration curve is generated from test data to show the incremental change in thermal expansivity for different levels of density at a constant component volume ratio.

The preferred density range for the as-consolidated material is at least about 80% of theoretical density up to full theoretical density The actual acceptable density range for a particular composition and use depends on a number of factors, e.g., the desired part strength, the desired thermal conductivity of the part, the net shape of the part, and the desired thermal expansion characteristic for the part. A part that is consolidated to 90–95% of theoretical density has greater strength and can be formed into a more complex shape than a part that has been consolidated to 80% of its theoretical density.

The density, and thereby the porosity, of the composite material is controlled in the consolidation step, preferably during hot consolidation, i.e., during sintering, SCR, or HIP'ng. In product forms that are not sintered, density is controlled by adjusting the pressure at which the powder mixture is rolled or pressed. The density of sintered forms is adjusted by controlling the temperature and/or the time parameters of the hot consolidation step within the following limitations.

Elemental metal powders are preferably sintered below their melting point, whereas pre-alloyed powders are preferably sintered below their incipient melting point. In practice this means heating the composite material to a temperature not greater than 25° F. below either the melting point or the incipient melting point of the lowest melting point component in the composite. For example, copper-tungsten and copper-molybdenum composites are preferably sintered at 1950° F. because the melting point for copper is 1981° F.

The highest sintering temperature suitable for a particular composition is selected with consideration of the restricted amount of intermetallic diffusion that can be tolerated. The consolidated part or article according to the present invention has a heterogeneous composition that preferably is substantially free of any alloyed phase resulting from alloying or intermetallic diffusion. In practice, however, a very small amount of such an alloyed phase can be tolerated without a measurable adverse effect. In general, if such alloyed phase is observable under a light microscope at 100×-200× magnification, then a measurable adverse effect on the thermal expansion property is to be expected.

When a reduced sintering temperature is used to limit the amount of densification, the lowest sintering temperature for a particular composite is selected in light of the minimum acceptable part strength. Preferably, the sintering temperature is not lower than two-thirds of the melting point of the lowest melting point component in the composite material.

Sintering time is preferably long enough to heat the part to a uniform temperature and permit metallurgical diffusion among the particles of the lowest melting point metal powder For copper-tungsten and copper-molybdenum materials, sintering time is typically 1 to 2 hours maximum at temperature. A shorter sintering time is used for smaller parts or to limit the amount of densification in larger parts.

The terms and expressions which have been employed are used as terms of description and not of limitation. There is no intention in the use of such terms and expressions of excluding any equivalents of the features shown and described, or portions thereof. It is recognized, however, that various modifications are possible within the scope of the invention claimed.

What is claimed is:

1. A process for making a low thermal expansion, high thermal conductivity member suitable for bonding to a support member at a predetermined bonding temperature and for facilitating the transfer of heat therefrom, said support member having a known thermal expansion characteristic curve over the temperature range from about 30° C. up to the bonding temperature, said process comprising the steps of:

making a mixture containing at least about 5% by weight of a first metal powder and the balance being a second metal powder, said second metal powder having an average thermal expansion coefficient less than that of said first metal powder over the range from about 30° C. up to the bonding temperature, said first metal powder having a thermal conductivity greater than that of said second metal powder; and controlling the consolidation of the metal powder mixture so as to provide a shaped member having a thermal expansion characteristic curve that essentially matches the thermal expansion characteristic curve of the support member over the range from about 30° C. up to the bonding temperature.

2. A process as set forth in claim 1 wherein the step of controlling the consolidation of the metal powder mixture comprises the steps of:

selecting a density for the metal powder mixture that results in a thermal expansion characteristic curve for said metal powder mixture that essentially matches the thermal expansion characteristic curve of said support member over said temperature range; and then consolidating the metal powder mixture to the selected density.

3. A process as set forth in claim 2 wherein before the selecting step said process comprises the steps of:

determining the thermal expansion characteristic curve of said metal powder mixture over said temperature range, when said mixture has been consolidated to a first preselected density; and then determining if there is a difference in magnitude between the thermal expansion characteristic curves of said support member and said metal powder mixture over said temperature range.

4. A process as set forth in claim 1 wherein the step of making the metal powder mixture comprises the step of apportioning the first and second metal powders by volume fraction in the mixture to provide a composite having a thermal expansion characteristic curve that approximates the thermal expansion characteristic curve of the ceramic material over the range from about 30° C. up to the bonding temperature.

5. A process as recited in claim 4 wherein the step of apportioning the first and second metal powders comprises the steps of:

selecting a ratio for the proportions of said first and second metal powders that results in a thermal expansion characteristic curve for said metal powder mixture that approximates the thermal expansion characteristic curve of said support member over said temperature range; and then combining the first and second metal powders according t the selected ratio.

6. A process as set forth in claim 5 wherein, before selecting the ratio, said process comprises the steps of:

determining the thermal expansion characteristic curve of said metal powder mixture over the temperature range, when said mixture has been consolidated to a second preselected density; and then determining if there is a difference in magnitude between the thermal expansion characteristic curves of said support member and said metal powder mixture over said temperature range.

7. A process as set forth in claim 6 wherein the mixture is made of first and second metal powders that are essentially insoluble in each other.

8. A process as set forth in claim 7 wherein said second metal powder is selected from the group consisting of tungsten, molybdenum, iron-nickel alloys, iron-cobalt-nickel alloys, and a combination thereof.

9. A process as set forth in claim 3 wherein the step of making the metal powder mixture comprises the step of apportioning the first and second metal powders by volume fraction in the mixture to provide a composite having a thermal expansion characteristic curve that approximates the thermal expansion characteristic curve of the ceramic material over the range from about 30° C. up to the bonding temperature.

10. A process as recited in claim 9 wherein the step of apportioning the first and second metal powders comprises the steps of:

selecting a ratio for the proportions of said first and second metal powders that results in a thermal expansion characteristic curve for said metal powder mixture that approximates the thermal expansion characteristic curve of said support member over said temperature range; and then combining the first and second metal powders according to the selected ratio.

11. A process as set forth in claim 10 wherein, before selecting the ratio, said process comprises the steps of:

determining the thermal expansion characteristic curve of said metal powder mixture over the temperature range, when said mixture has been consolidated to a second preselected density; and then determining if there is a difference in magnitude between the thermal expansion characteristic curves of said support member and said metal powder mixture over said temperature range.

12. A process as set forth in claim 11 wherein the mixture is made of first and second metal powders that are essentially insoluble in each other.

13. A process as set forth in claim 12 wherein said second metal powder is selected from the group consisting of tungsten, molybdenum, iron-nickel alloys, iron-cobalt-nickel alloys, and a combination thereof.

14. A composite powder metallurgy member suitable for bonding to a support member at a predetermined bonding temperature and for facilitating the transfer of heat therefrom, said support member having a known thermal expansion characteristic curve over the temperature range from about 30° C. up to the bonding temperature, said member being formed of a composite material consisting essentially of at least about 5% by weight of a first metal powder and the balance being a second metal powder wherein said first metal powder has an average thermal expansion coefficient less than that of said second metal powder over said temperature range and said second metal powder has a thermal conductivity greater than that of said first metal powder, and said composite powder metallurgy member having been consolidated in a controlled manner so as to provide a thermal expansion characteristic curve that essentially matches the thermal expansion characteristic curve of said support member over said temperature range.

15. A composite powder metallurgy as set forth in claim 14 wherein the first and second metal powders, before consolidation, are apportioned by volume fraction in the composite material to provide a thermal expansion characteristic curve that approximates the thermal expansion characteristic curve of the support member over the range from about 30° C. up to the bond temperature.

16. A composite powder metallurgy member as set forth in claim 15 wherein the first and second metal powders are essentially insoluble in each other.

17. A composite powder metallurgy member as set forth in claim 16 wherein said second metal powder is selected from the group consisting of tungsten, molybdenum, iron-nickel alloys, iron-cobalt-nickel alloy, and a combination thereof.

* * * * *

UNITED STATES PATENT AND TRADEMARK OFFICE

CERTIFICATE OF CORRECTION

PATENT NO. : 5,049,184

DATED : September 17, 1991

INVENTOR(S) : LESLIE L. HARNER and GREGORY J. DEL CORSO

It is certified that error appears in the above-identified patent and that said Letters Patent is hereby corrected as shown below:

Column 2:

Line 46: after "up to" insert --the bonding temperature.--

Column 5:

Line 15: after "methods" insert --.-- (period);

Line 50: after "ing" insert --.-- (period).

Column 6:

Line 21: after "bonding the" insert --shaped--;

Line 44: after "density" insert --.-- (period).

Column 8:

Line 36: "t" should read --to--.

Column 10:

Line 12: after "metallurgy" insert --member--;

Line 20: "bond" should read --bonding--.

Signed and Sealed this

Sixteenth Day of March, 1993

*Attest:*

STEPHEN G. KUNIN

*Attesting Officer*

*Acting Commissioner of Patents and Trademarks*